US010245703B2

(12) United States Patent
Nienaber et al.

(10) Patent No.: US 10,245,703 B2
(45) Date of Patent: Apr. 2, 2019

(54) LATTERALLY-STRETCHED NETTING BEARING ABRASIVE PARTICLES, AND METHOD FOR MAKING

(71) Applicant: 3M INNOVATIVE PROPERTIES COMPANY, St. Paul, MN (US)

(72) Inventors: Aaron K. Nienaber, Maplewood, MN (US); Ronald W. Ausen, St. Paul, MN (US); John M. Brandner, St. Paul, MN (US); Thomas J. Nelson, St. Paul, MN (US); Stephen M. Sanocki, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 117 days.

(21) Appl. No.: 15/165,848

(22) Filed: May 26, 2016

(65) Prior Publication Data

US 2016/0354898 A1 Dec. 8, 2016

Related U.S. Application Data

(60) Provisional application No. 62/169,749, filed on Jun. 2, 2015.

(51) Int. Cl.

| | |
|---|---|
| ***C09K 3/14*** | (2006.01) |
| ***B24D 3/00*** | (2006.01) |
| ***B24D 18/00*** | (2006.01) |
| *B42D 3/00* | (2006.01) |
| *B42D 3/02* | (2006.01) |
| *B42D 11/00* | (2006.01) |

(52) U.S. Cl.
CPC ..... *B24D 3/002* (2013.01); *B24D 18/0072* (2013.01)

(58) Field of Classification Search
USPC ..... 51/298, 293, 307
See application file for complete search history.

(56) References Cited

U.S. PATENT DOCUMENTS

| | | | | |
|---|---|---|---|---|
| 6,487,002 | B1 | 11/2002 | Biegelsen | |
| 6,833,014 | B2 | 12/2004 | Welygan | |
| 7,258,705 | B2 | 8/2007 | Woo | |
| 7,285,146 | B2 | 10/2007 | Petersen | |
| 2004/0170801 | A1* | 9/2004 | Seth | A44B 18/0053 428/100 |
| 2007/0028525 | A1* | 2/2007 | Woo | B24D 11/02 51/298 |
| 2011/0130732 | A1 | 6/2011 | Jackels | |
| 2013/0344786 | A1 | 12/2013 | Keipert | |
| 2014/0106126 | A1 | 4/2014 | Gaeta | |
| 2014/0234606 | A1 | 8/2014 | Ausen | |
| 2014/0290147 | A1* | 10/2014 | Seth | B24D 18/0054 51/298 |

FOREIGN PATENT DOCUMENTS

| | | |
|---|---|---|
| WO | WO 2012-112305 | 8/2012 |
| WO | WO 2015-100018 | 7/2015 |
| WO | WO 2015-100020 | 7/2015 |
| WO | WO 2015-100220 | 7/2015 |

* cited by examiner

*Primary Examiner* — James E McDonough
(74) *Attorney, Agent, or Firm* — Kenneth B. Wood

(57) ABSTRACT

A laterally-stretched netting comprising a patterned abrasive layer on a first major surface thereof, and methods of making.

16 Claims, 4 Drawing Sheets

LATTERALLY-STRETCHED NETTING BEARING ABRASIVE PARTICLES, AND METHOD FOR MAKING

BACKGROUND

Coated abrasive articles are conventionally coated by either drop coating or electrostatic coating of the abrasive particles onto a resin-coated backing. In general, positioning and orientation of the abrasive particles and their cutting points can be important in determining abrasive performance.

SUMMARY

In broad summary, herein is disclosed a laterally-stretched netting comprising a patterned abrasive layer on a first major surface thereof, and methods of making. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). The term "substantially", unless otherwise specifically defined, means to a high degree of approximation (e.g., within +/−10% for quantifiable properties. The term "essentially" means to a very high degree of approximation (e.g., within plus or minus 2% for quantifiable properties); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. All references herein to numerical parameters (dimensions, ratios, and so on) are understood to be calculable (unless otherwise noted) by the use of average values derived from a number of measurements of the parameter, particularly for the case of a parameter that is variable.

DETAILED DESCRIPTION

Glossary

Figure 2:
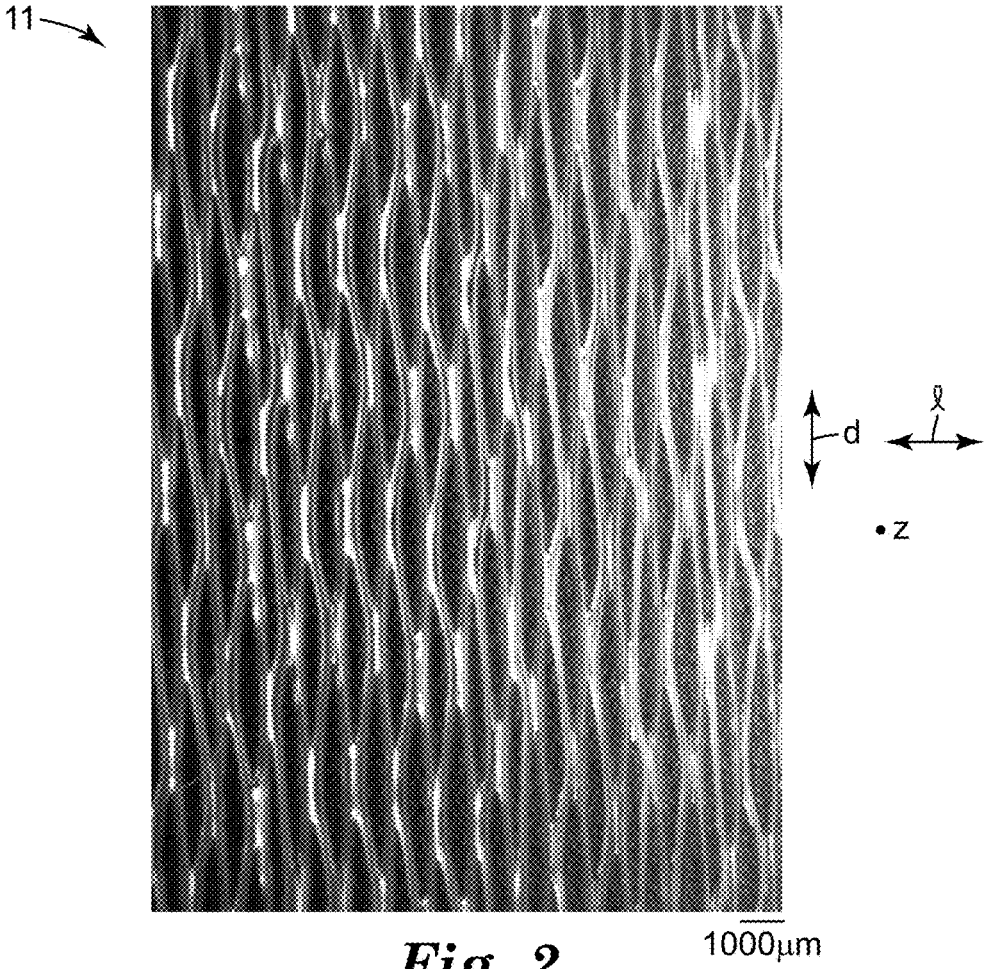
FIG. 2 is an optical micrograph at 20× magnification of an exemplary unstretched netting.

The terms "lateral" and "laterally" as used with respect to a netting means a crossweb direction, i.e., a direction that is perpendicular to the downweb direction of the netting (by way of specific example, lateral and downweb directions are identified in FIG. 2). The "z" direction is perpendicular to the lateral and downweb directions of the netting.

Figure 7:
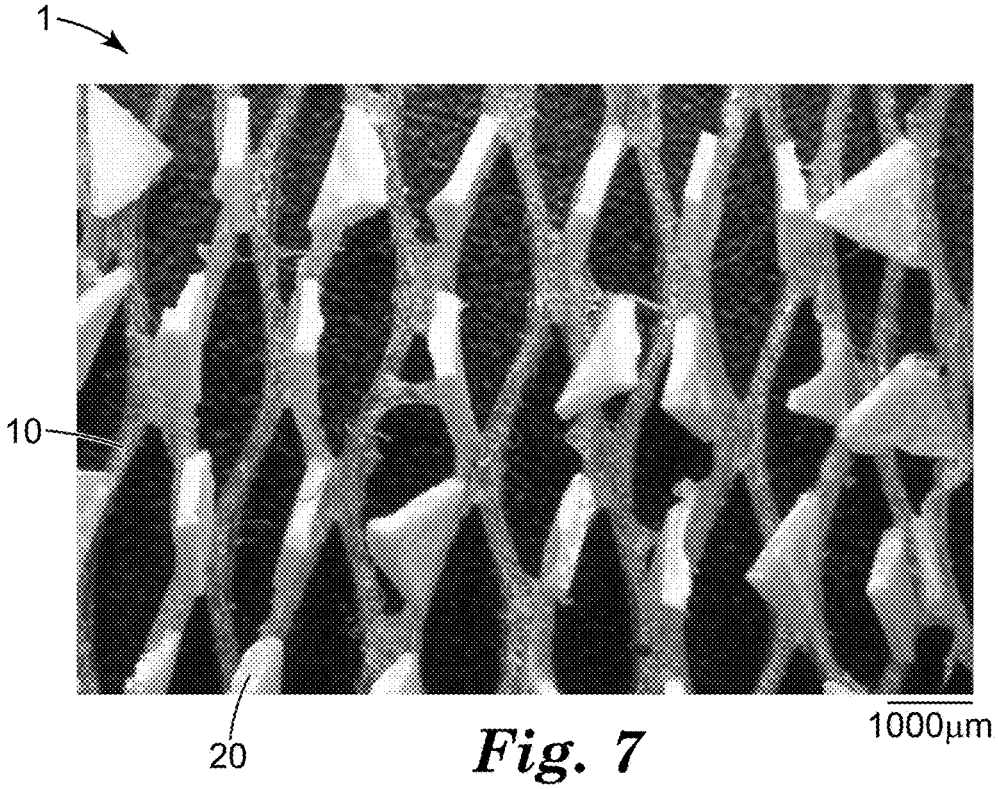
FIG. 7 is an optical micrograph at 30× magnification of an exemplary laterally-stretched netting comprising abrasive particles bonded to a first major surface thereof.

The term "orientation" with respect to a shaped abrasive particle means the angular configuration that the particle is arranged in, relative to the plane defined by the first major surface of the netting. (By way of specific example, the idealized abrasive particles of FIG. 1, and the actual abrasive particles of FIGS. 7 and 8, are pyramidal-shaped particles that are oriented in a tip-outward configuration.)

By "singly" bonded is meant that an abrasive particle is bonded to a strand of a first set of strands, or to a strand of a second set of strands, but is not bonded to strands of both the first and second sets of strands, as described in further detail below.

Figure 1:
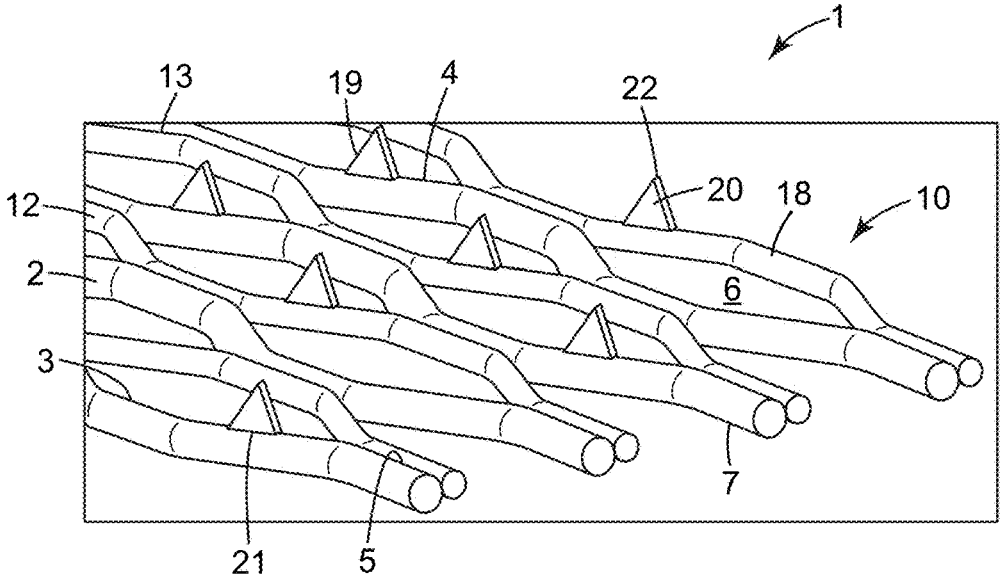
FIG. 1 is an idealized side-perspective view of a stretched netting comprising abrasive particles singly bonded to first and second polymer strands thereof.

As shown in idealized representation in FIG. 1, disclosed herein is a laterally-stretched abrasive product 1 comprising a laterally-stretched netting 10 with a patterned abrasive layer 19 provided on a first major surface 4 thereof. (The term abrasive layer is used for convenience to denote a multiplicity of abrasive particles and does not imply that the particles must necessarily collectively form a continuous layer.) Laterally-stretched netting 10 comprises a lateral width and is comprised of a first set of polymer strands 2 and a second set of polymer strands 12, polymer strands of the first set being bonded to polymer strands of the second set at bond regions 5. Strands of the first set of strands comprise first surfaces 3; strands of the second set of strands comprise first surfaces 13; these first surfaces of the first and second sets of strands collectively define a first major surface 4 of the netting 10. (It is noted that first major surface 4 of netting 10 is discontinuous, i.e. it has numerous through-holes penetrating therethrough.)

A make coat layer 18 is provided on at least a portion of first major surface 4 of netting 10; specifically, a make coat layer is provided on at least some of the first surfaces 3 of at least some strands of the first set of strands 2, and on at least some of the first surfaces 13 of at least some strands of the second set of strands 12. A plurality of abrasive particles 20 are bonded to first major surface 4 of the netting 10 by way of the make coat layer 18. Specifically, a majority of the abrasive particles 20 are each singly bonded, by way of the make coat layer, to a first surface 3 of a strand of the first set of polymer strands 2, or to a first surface 13 of the second set of polymer strands 12. By a majority of meant at least 50% by number. By singly bonded is meant that an abrasive particle is bonded to a strand of the first set of strands 2, or to a strand of the second set of strands 12, but is not bonded to strands of both the first and second sets of strands. (This condition does not imply, or require, that any strand may only have a single abrasive particle bonded to it.) Singly bonded abrasive particles 20 are shown in idealized representation in FIG. 1; also, numerous singly-bonded abrasive particles are visible in the optical micrograph of a Working Example laterally-stretched netting bearing abrasive particles thereon, in FIG. 7.

Figure 3:
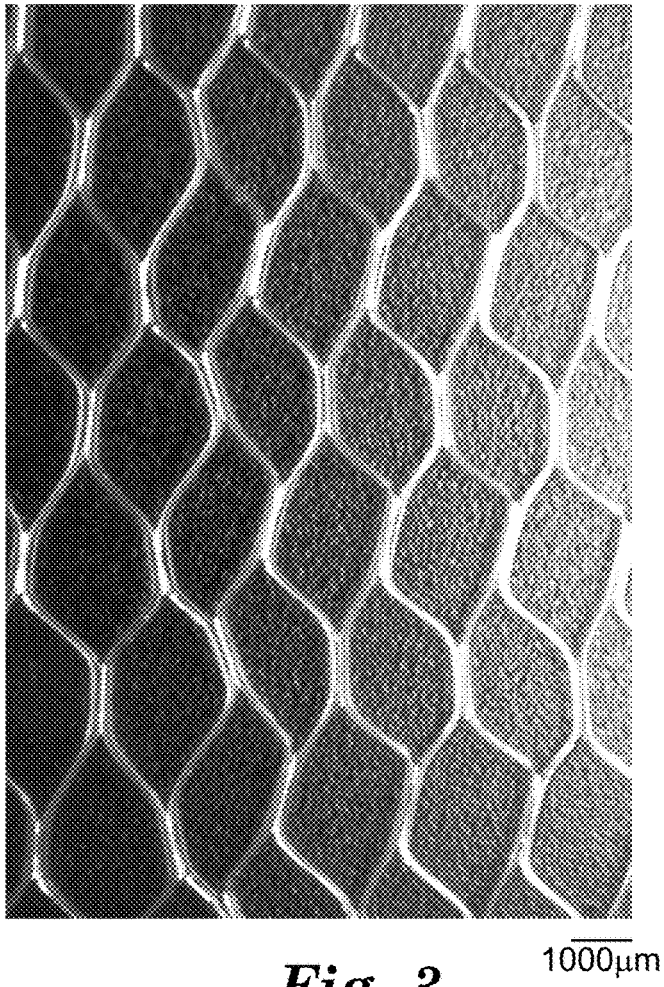
FIG. 3 is an optical micrograph at 20× magnification of an exemplary laterally-stretched netting.

As noted, unstretched polymer netting 11 comprises a first set of strands 2 and a second set of strands 12. An optical micrograph of an exemplary unstretched netting is shown in FIG. 2 (for comparison, an optical micrograph of a similar netting after being laterally stretched, is shown in FIG. 3). In some embodiments the strands of the first set and the strands of the second set may exhibit at least some segments in which the strands of the first set extend in a different direction from the strands of the second set. The strands of the first set and the strands of the second set are bonded to each other at bonding regions 5; in non-bonding regions the strands are separated from each other so that the netting comprises a multiplicity of through-holes extending therethrough from first major surface 4 of the netting to second, opposing major surface 7 of the netting. In many embodiments, the strands of the first and second strands are all at least generally coplanar. In further embodiments, and the netting does not comprise any polymer strands other than those of the first and second sets.

Figure 4:
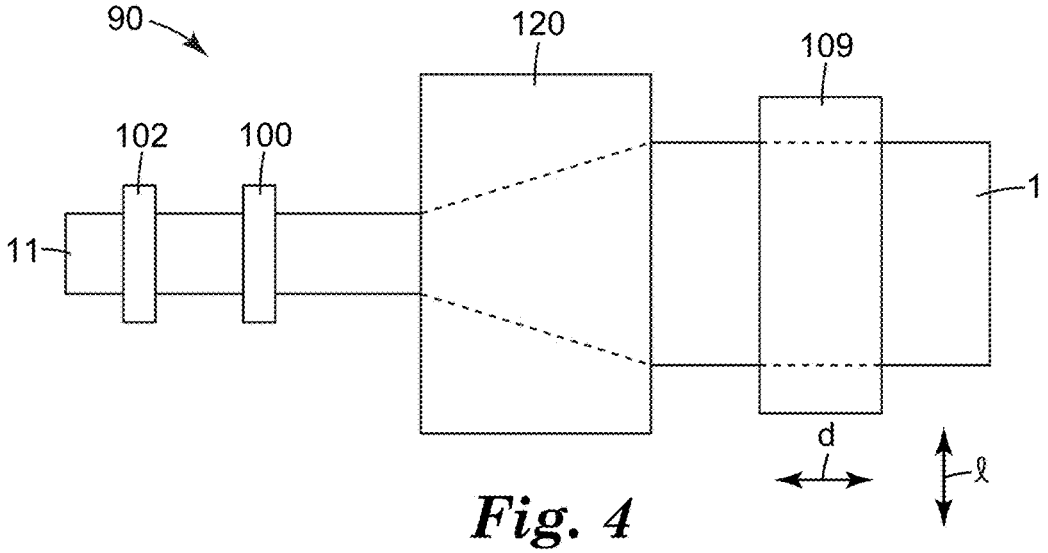
FIG. 4 is an idealized top view of an apparatus and process for making a laterally-stretched netting comprising abrasive particles bonded to a first major surface thereof.
Figure 5:
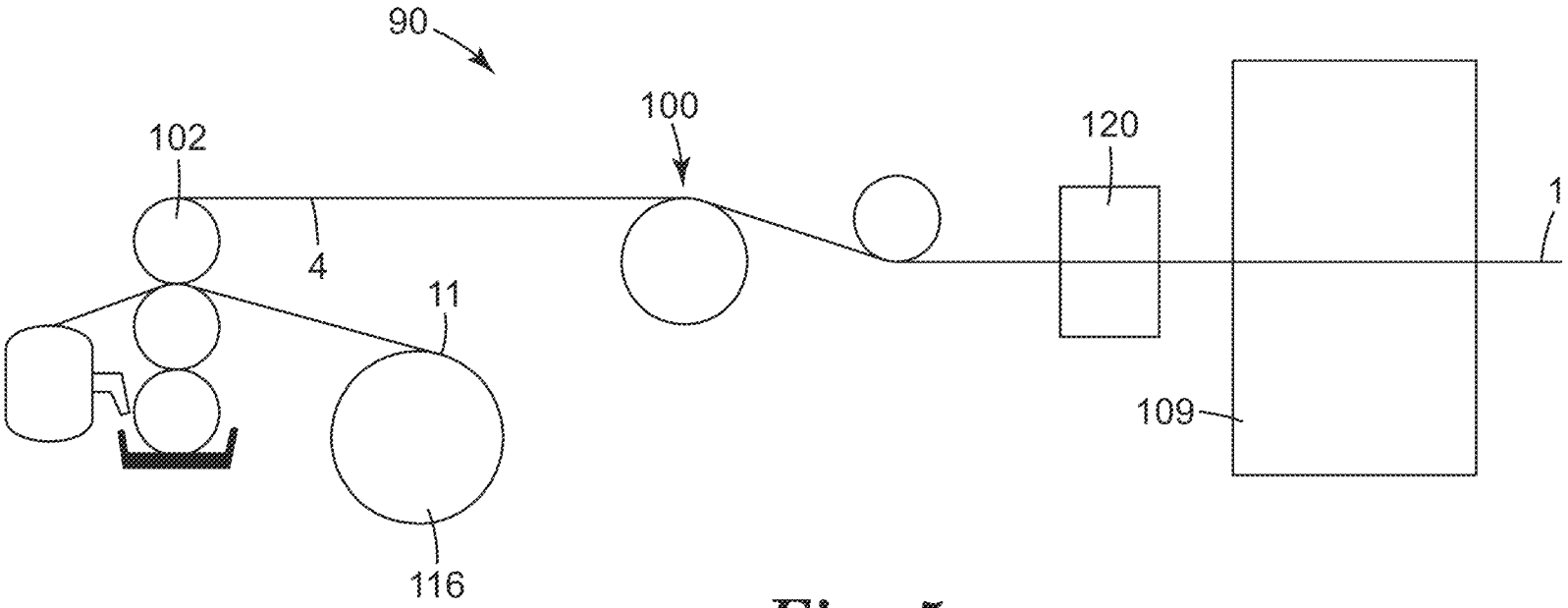
FIG. 5 is an idealized side view of an apparatus and process for making a laterally-stretched netting comprising abrasive particles bonded to a first major surface thereof.

A make coat layer 18 is coated onto the first major surface 4 of unstretched netting 11 so that at least some first surfaces 3 of strands of the first set of strands 2, and some first surfaces 13 of strands of the second set of strands 12, are make-coated strands. (Strictly speaking, what is coated may be referred to as a make coat precursor, but the term make coat is used herein for convenience). The make coat layer 18 may be of any suitable composition and may be coated using any suitable method. Suitable materials for the make coat layer 18 include e.g. phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. The make coat layer 18 may be coated onto first major surface 4 of unstretched netting 11 by any suitable technique, such as knife coating, spray coating, roll coating, rotogravure coating, curtain coating, screen printing, and the like. An exemplary make coating station 102 is shown in FIGS. 4 and 5; unstretched netting 11 may be delivered from unwind 116 to make coating station 102 for the purpose of applying make coat layer 18 to first major surface 4 of unstretched netting 11.

Abrasive particles 20 are then deposited onto the first major surface 4 of unstretched netting 11. (With reference to FIGS. 4 and 5, the particles may be deposited at particle deposition station 100.) Specifically, the particles 20 are contacted with, e.g. partially embedded in, the make coat layer. This may be done by any suitable process as long as the abrasive particles are deposited in a pre-determined pattern. Various specific deposition methods may be particularly useful in providing patterned deposition.

For example, the depositing of abrasive particles in a pre-determined pattern may be performed by the use of one or more apertured screens, each of which apertures is configured to position an abrasive particle in a specific z-directional orientation, and which apertures are spaced and patterned in a predetermined pattern. Such methods are described in further detail in U.S. Patent Application Publication 2013/0344786 to Keipert, which is incorporated by reference in its entirety herein.

In some embodiments, the depositing of abrasive particles in a pre-determined pattern maybe performed by the use of a transfer tool having a dispensing surface with a plurality of cavities, wherein abrasive particles are dispensed from an abrasive particle feeder onto the dispensing surface and into the plurality of cavities, and wherein the abrasive particles are transferred from the plurality of cavities to the first surfaces of the make-coated strands that define the first major surface of the netting. Such methods are described in further detail in PCT Patent Application Serial Number US2014/071855, entitled A COATED ABRASIVE ARTICLE MAKER APPARATUS, which is incorporated by reference in its entirety herein. In specific embodiments, the abrasive particles may be sized so that each abrasive particle fits singly and completely into a cavity of the plurality of cavities. Such methods are described in further detail in PCT Patent Application Serial Number US2014/069680, entitled ABRASIVE PARTICLE POSITIONING SYSTEMS AND PRODUCTION TOOLS THEREFOR, which is incorporated by reference in its entirety herein. In other specific embodiments, at least some of the cavities may be elongated cavities that exhibit a longitudinal axis, and at least some of the abrasive particles may be elongated particles that exhibit a longitudinal axis. In such a case the abrasive particles may be dispensed onto the dispensing surface and into the plurality of cavities, so that at least some of the elongated particles are disposed in the elongated cavities such that the longitudinal axis of the particle is at least substantially parallel to the longitudinal axis of the elongated cavity. Such methods are described in further detail in PCT Patent Application Serial Number US2014/069726, entitled METHOD OF MAKING A COATED ABRASIVE ARTICLE, which is incorporated by reference in its entirety herein.

After the abrasive particles are deposited onto the make coat layer, the make coat layer may optionally be partially hardened (e.g., cured) if desired.

The unstretched netting is then laterally stretched to any desired amount. (With reference to FIGS. 4 and 5, this may be performed at lateral stretching station 120.) The lateral stretching may be performed by the use of any suitable apparatus and method, e.g. a tentering apparatus or the like. If desired, the lateral stretching may be performed in-line with either or both of the make-coating and abrasive-depositing processes (as in the exemplary arrangements depicted in FIGS. 4 and 5). Or, in other embodiments, the lateral stretching may be performed as a separate operation. The lateral stretching may be performed in a continuous, in-line manner; or it may be performed batchwise, on pieces of the unstretched netting.

In various embodiments, the lateral stretching may be done to a stretching factor of at least about 25% (the laterally-stretched web being 25% wider than the unstretched precursor), of at least about 50%, of at least about 100%, of at least about 150%, or of at least about 200%. In various embodiments, the lateral stretching process may increase the percent open area (described in detail below) of the netting by a factor of at least about 1.1, 1.2, 1.4, 1.6, 1.8, 2.0, 2.5, or 3.0, relative to the unstretched netting. The laterally-stretched netting may, if desired, be held at high temperature for a desired period of time, e.g. in order to anneal the polymer material of the netting, so that when the stretching force is removed the laterally-stretched netting may retain much of its laterally-stretched dimension.

Other layers, e.g. an optional size coat, may be optionally coated onto the article, either before or after the stretching.

After the stretching process is completed, the make coat layer can be hardened by any method suitable for the particular make coat composition that was used. (With reference to FIGS. 4 and 5, this may be performed at make coat hardening station 109, which may be e.g. an oven, a photocuring apparatus, or some other apparatus, depending on the particular make coat that was used.)

It will be appreciated that the apparatus and methods disclosed herein can allow particles to be deposited upon an unstretched netting; that is, a netting that is somewhat sheetlike in terms of having a relatively low percent open area. This can allow the particles to be deposited on the first major surface of the unstretched sheeting with a relatively high yield (in other words, few particles may be "deposited" into a through-opening of the unstretched netting and thus be lost or have to be reclaimed). The stretching process can then provide a patterned array of abrasive particles as desired, with at least a majority (50%) of the particles being singly-bonded as noted above. In various embodiments, at least about 55, 60, 65, 70, or 75% of the particles, by number, are singly-bonded particles.

The initial, unstretched netting 11 may be any polymeric netting that can be laterally stretched. As noted earlier, unstretched polymer netting 11 *a* comprises a first set of strands 2 and a second set of strands 12. In some embodiments the strands of the first set and the strands of the second set may exhibit at least some segments in which the strands of the first set extend in a different direction from the strands of the second set. The strands of the first set and the strands of the second set are bonded to each other at bonding regions 5; in non-bonding regions the strands are separated from each other so that the netting comprises a multiplicity of through-holes extending therethrough from first major surface 4 of the netting to second, opposing major surface 7 of the netting. In many embodiments, the strands of the first and second strands are all generally coplanar. In further embodiments, and the netting does not comprise any polymer strands other than those of the first and second sets.

In particular embodiments, the netting may be in the form of first 2 and second 12 polymer strands that are periodically joined together at bond regions 5 throughout the netting, but that do not substantially cross over each other. Such nettings and methods of producing such nettings, are described in detail in U.S. Patent Application Publication 2014/0234606 to Ausen, which is incorporated by reference in its entirety herein.

The netting material can be an organic polymeric material, such as a thermoplastic material. Useful materials include, but are not limited to, polyurethanes, polyamides, polyolefins (for example, polyethylene and polypropylene), polyesters, and combinations thereof. The hooks may also comprise one or more additives, including but not limited to fillers, fibers, antistatic agents, lubricants, wetting agents, surfactants, pigments, dyes, coupling agents, plasticizers, and suspending agents.

The ordinary artisan will appreciate that laterally-stretched netting 10 will be distinguished from other, unstretched nettings (even such nettings as may have been made with similar open area, percent open area, and/or strand diameter). Specifically, the ordinary artisan will understand that the lateral stretching process will characteristically impart one or more signatures (e.g. evidence of bonds between strands having been partially broken, evidence of elongation of at least some strand segments, and so on) that reveal that a lateral stretching process has been performed on the netting. Furthermore, a netting as defined and described herein will be distinguished (e.g., by way of being comprised of essentially a monolayer of first and second fiber strands) from such conventional nonwoven materials as carded webs, airlaid webs, blown webs, melt-spun webs and so on (which webs typically are comprised of many layers of fibers).

The openings 6 in the laterally-stretched netting 10 may have any suitable shape. In various embodiments, the openings can be generally square shaped, rectangular, circular, oval shape, triangular, diamond-shaped, a parallelogram shape, a polygon shape, or a combination of these shapes, or an irregular shape. In some embodiments the openings 6 may be relatively uniform in shape. In other embodiments, the openings may vary in shape.

The laterally-stretched netting 10 may exhibit an open area of any suitable size. The "open area" of an opening in the netting refers to the area of the opening as measured over the thickness of the netting (i.e., the area bounded by the perimeter of material forming the opening through which a three-dimensional object could pass). In various embodiments, laterally-stretched nettings useful in the present invention may have an average open area of at least about 0.3 square millimeters per opening. In some embodiments, the laterally-stretched netting has an average open area of at least about 0.5 square millimeters per opening. In yet further embodiments, the laterally-stretched netting has an average open area of at least about 0.7 square millimeters per opening. In some embodiments the openings 6 may be relatively uniform in size. In other embodiments, the openings may vary in size.

The laterally-stretched netting may exhibit a percent open area of any suitable value. The percent open area is defined as the amount of open area per unit area of netting (e.g., square cm of open area per square cm of netting, expressed as a percentage). In various embodiments, the laterally-stretched netting may exhibit a percent open area in the range of at least about 60, 70, 80, or 90. In further embodiments, the laterally-stretched netting may exhibit a percent open area in the range of at most about 95, 90, 85, 80, 75, or 60.

The abrasive particles 20 have sufficient hardness and surface roughness to function as abrasive particles in abrading processes. In various embodiments, the abrasive particles may exhibit a Mohs hardness of at least 4, at least 5, at least 6, at least 7, or even at least 8. Exemplary abrasive particles include crushed, shaped abrasive particles (e.g., shaped ceramic abrasive particles or shaped abrasive composite particles), and combinations thereof.

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide;

quartz; feldspar; flint; emery; sol-gel-derived abrasive particles (e.g., including shaped and crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art.

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent to the binder.

In some embodiments, the abrasive particles comprise ceramic abrasive particles such as, for example, sol-gel-derived polycrystalline alpha alumina particles. The abrasive particles may be may be crushed or shaped, or a combination thereof.

Shaped ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Patent Application Publication Nos. 2009/0165394 A1 (Culler et al.) and 2009/0169816 A1 (Erickson et al.).

Alpha alumina-based shaped ceramic abrasive particles can be made according to well-known multistep processes. Briefly, the method comprises the steps of making either a seeded or non-seeded sol-gel alpha alumina precursor dispersion that can be converted into alpha alumina; filling one or more mold cavities having the desired outer shape of the shaped abrasive particle with the sol-gel, drying the sol-gel to form precursor shaped ceramic abrasive particles; removing the precursor shaped ceramic abrasive particles from the mold cavities; calcining the precursor shaped ceramic abrasive particles to form calcined, precursor shaped ceramic abrasive particles, and then sintering the calcined, precursor shaped ceramic abrasive particles to form shaped ceramic abrasive particles. Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Patent Application Publication No. 2009/0165394 A1 (Culler et al.).

Although there is no particular limitation on the shape of the shaped ceramic abrasive particles, the abrasive particles are preferably formed into a predetermined shape by shaping precursor particles comprising a ceramic precursor material (e.g., a boehmite sol-gel) using a mold, followed by sintering. The shaped ceramic abrasive particles may be shaped as, for example, pillars, pyramids, truncated pyramids (e.g., truncated triangular pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the shaped ceramic abrasive particles are precisely-shaped in that individual shaped ceramic abrasive particles will have a shape that is essentially the shape of the portion of the cavity of a mold or production tool in which the particle precursor was dried, prior to optional calcining and sintering.

Shaped ceramic abrasive particles can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a pyramid, e.g. a truncated pyramid. The resultant shaped ceramic abrasive particles have a respective nominal average shape that corresponds to the shape of cavities (e.g., truncated pyramid) in the tool surface; however, variations (e.g., random variations) from the nominal average shape may occur during manufacture, and shaped ceramic abrasive particles exhibiting such variations are included within the definition of shaped ceramic abrasive particles as used herein.

In some embodiments, the base and the top of the shaped ceramic abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As noted, ceramic abrasive particles can be in the form of shaped ceramic abrasive particles. Examples of sol-gel-derived shaped alpha alumina (i.e., ceramic) abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, sol-gel-derived shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Patent Application Publication Nos. 2012/0227333 (Adefris et al.); 2013/0040537 (Schwabel et al.); and 2013/0125477 (Adefris).

In some preferred embodiments, the abrasive particles comprise shaped ceramic abrasive particles (e.g., shaped sol-gel-derived polycrystalline alpha alumina particles) that are generally triangularly-shaped (e.g., a triangular prism or a truncated three-sided pyramid).

As used herein in referring to shaped ceramic abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

Shaped ceramic abrasive particles may be selected to have a length in a range of from e.g. 1 micron to 15000 microns, 10 microns to about 10000 microns, or 150 to 2600 microns, although other lengths may also be used. Shaped ceramic abrasive particles may be selected to have a width in a range of from e.g. 0.1 micron to 3500 microns, 100 microns to 3000 microns, or 100 microns to 2600 microns, although other lengths may also be used. Shaped ceramic abrasive particles may be selected to have a thickness in a range of from 0.1 micron to 1600 microns, more typically from 1 micron to 1200 microns, although other thicknesses may be used. In some embodiments, shaped ceramic abrasive particles may have an aspect ratio (length to thickness) of at least 2, 3, 4, 5, 6, or more.

Surface coatings on the shaped ceramic abrasive particles may be used to improve the adhesion between the shaped ceramic abrasive particles and a make coat layer, or can be used to aid in e.g. deposition of the shaped ceramic abrasive particles. The abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard).

Figure 6:
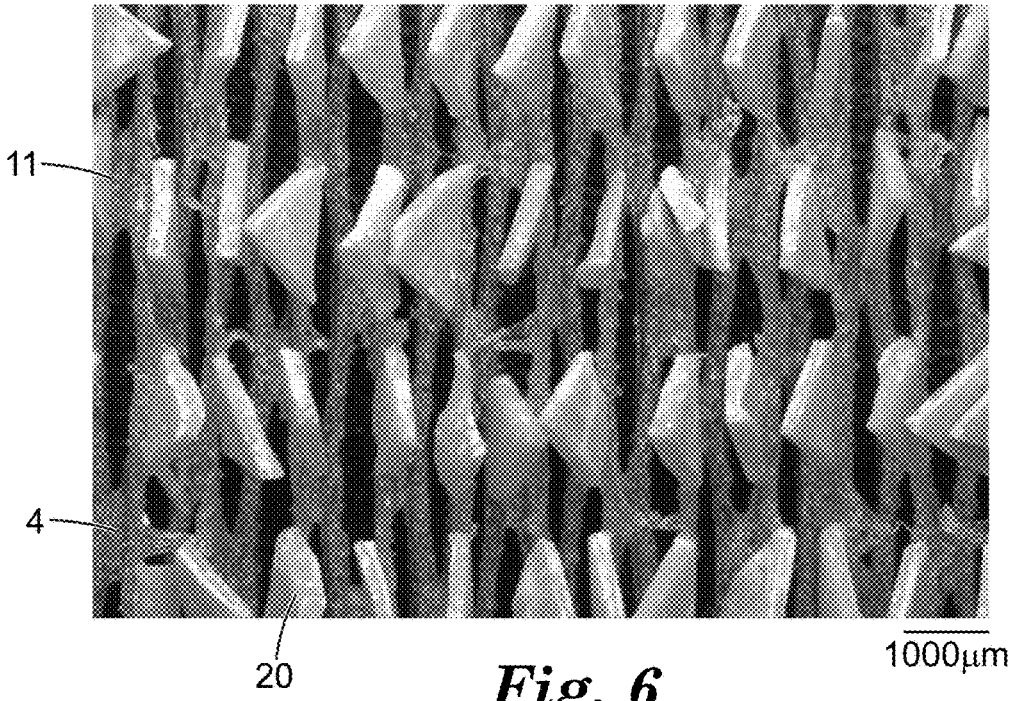
FIG. 6 is an optical micrograph at 30× magnification of an exemplary unstretched netting comprising abrasive particles bonded to a first major surface thereof.

In at least some embodiments, the abrasive particles 20 are shaped particles that are in the form of pyramids, that are placed on major surface 4 of unstretched netting 11 in a "tip-out" configuration; that is, with a tip (that is identifiable even if the abrasive particle is in the form of a truncated pyramid) that faces outward from major surface 4 of the netting, and with a base that is bonded (by way of the make coat layer) to major surface 4 of unstretched netting 11. An actual optical micrograph of such an arrangement is shown in FIG. 6.

The product article 1, (laterally-stretched netting 10 bearing the patterned abrasive layer thereon, as shown in exemplary embodiment in FIG. 7) may be further processed in any suitable manner. The netting may be converted, for example, into belts, rolls, discs (including perforated discs), and/or sheets.

In particular embodiments, the product article 1 may be attached, e.g. by needle-tacking, to a support layer, e.g. a fibrous support layer such as a nonwoven web of any desired thickness and stiffness.

In some embodiments, a fibrous support layer may comprise a coherent bonded-fiber nonwoven web made of interlaced randomly disposed flexible organic thermoplastic fibers at least some of which are adhesively bonded together by binder at points where the fibers intersect and contact each other, to form a web having three-dimensionally integrated structure. Abrasive particles may be distributed throughout the web and bonded to the web by binder. The interstices between the fibers of the web are substantially unfilled with binder or abrasive. In one embodiment, the web includes a three-dimensionally extending network of intercommunicated voids such that the web includes, on average, at least about 75% by volume voids, at least about 85% by volume voids, at least about 90% by volume voids or even at least about 95% by volume voids. The web is flexible and readily compressible and, upon release of pressure, is capable of recovering substantially completely to its initial uncompressed form. Examples of webs of this type are disclosed in U.S. Pat. No. 2,958,593, which is incorporated herein by reference. Webs of this type are available from 3M Company, St. Paul, Minn. under the trade designation SCOTCH-BRITE.

In some embodiments, a fibrous support layer may comprise a coherent bonded-fiber nonwoven web made of first and second crimped, staple, organic bicomponent thermoplastic fibers, in which at least some of the first and second fibers of the web are melt-bonded together at least at a portion of the points where they contact each other. At least a portion of the first and second fibers of one major surface of the nonwoven web may have an abrasive coating (e.g., abrasive particles) bonded thereto, and at least a portion of the first and second fibers of the interior region may have no abrasive coating bonded thereto. Examples of webs of this type are disclosed in U.S. Pat. No. 5,685,935, which is incorporated herein by reference. Webs of this type are available from 3M Company, St. Paul, Minn. under the trade designation SCOTCH-BRITE.

In some embodiments, a fibrous support layer may comprise a coherent bonded-fiber nonwoven web made of interengaged continuous coiled or three-dimensionally undulated filaments of resilient thermoplastic polymer. At least some of the filaments are autogeneously bonded together or removably welded together at points of mutual contact to form a handleably integrated structure. The web may comprise abrasive granules dispersed throughout the web and bonded to the filaments by binder. Examples of webs of this type are disclosed in U.S. Pat. Nos. 3,837,988 and 4,227,350, which are incorporated herein by reference. Webs of this type are available from 3M Company, St. Paul, Minn. under the trade designation NOMAD.

In some embodiments, a fibrous support layer may comprise a coherent bonded-fiber nonwoven web that is a sponge-like, compressible, web made of randomly intermingled and randomly bonded hydrophobic fibers. The randomly intermingled fibers are bonded together either through fusion or with a binder at randomly spaced points where the fibers cross. The fibers of the web define, in effect, walls of a large multiplicity of open cells, which impart a high void volume to the web. Examples of webs of this type are disclosed in U.S. Pat. No. 3,537,121 and U.S. Pat. No. 3,910,284, both of which are incorporated herein by reference. Webs of this type are available from 3M Company, St. Paul, Minn. under the trade designation BUF-PUF.

In some embodiments, a fibrous support layer may comprise a coherent bonded-fiber web comprising irregularly looped and intermingled filaments in a highly porous, open, three-dimensional sheet structure. The filaments may be self-bonded (e.g., melt-bonded) to each other at points of fiber contact, and/or may form a peak-and-valley three-dimensional structure. Examples of webs of this type are disclosed in U.S. Pat. No. 4,212,692, U.S. Pat. No. 4,252,590, and U.S. Pat. No. 6,272,707, all of which are incorporated by reference herein. Webs of this type are available from Colbond Company of St. Denis La Plaine, France, under the trade designation ENKAMAT.

A fibrous support layer, if present may comprise any suitable thickness, basis weight, and the like. In various embodiments, support layer 300 is at least about 1 mm, at least about 2 mm, or at least about 4 mm, in thickness. In further embodiments, support layer 300 is at most 30 mm, at most about 20 mm, or at most about 15 mm, in thickness. In various embodiments, support layer 300 may comprise a basis weight of at least 50 gsm (grams per square meter), at least 100 gsm, or at least 200 gsm. In further embodiments, support layer 300 may comprise a basis weight of at most 4000 gsm, 3000 gsm, or 2000 gsm.

In some embodiments, multiple layers of product article 1 may be attached to each other (e.g., by needle-tacking). This may provide a product in which e.g. successive layers of abrasive-particle-bearing laterally-stretched netting may be exposed during the use of the product.

LIST OF EXEMPLARY EMBODIMENTS

Embodiment 1 is a method of making a laterally-stretched netting comprising a patterned abrasive layer on a first major surface thereof, the method comprising the steps of: providing a netting comprising a lateral width and comprising a first set of polymer strands and a second set of polymer strands, polymer strands of the first set being bonded to polymer strands of the second set at bond regions, and the first and second sets of strands comprising first surfaces that collectively define a first major surface of the netting; coating a make coat layer onto the first major surface of the netting so that at least some first surfaces of strands of the first set of strands, and some first surfaces of strands of the second set of strands, are make-coated strands; depositing abrasive particles onto at least some of the make-coated first surfaces of strands that define the first major surface of the netting, in a pre-determined pattern; laterally stretching the netting by a stretching factor of at least about 25%; and, hardening the make coat layer; whereby at least a majority of the abrasive particles are each singly bonded to a strand of the laterally-stretched netting.

Embodiment 2 is the method of embodiment 1 wherein the method includes partially hardening the make coat layer before laterally stretching the netting. Embodiment 3 is the method of any of embodiments 1-2 wherein the abrasive particles are shaped abrasive particles and wherein the depositing of the shaped abrasive particles is performed so that the particles are deposited onto the make-coated strands in a predetermined orientation. Embodiment 4 is the method of embodiment 3 wherein at least some of the shaped abrasive particles are at least generally shaped as pyramids with a tip and with a base opposing the tip, and wherein the shaped abrasive particles are deposited onto the make-coated first surfaces of the strands so that the base of the pyramid contacts the make-coated strands.

Embodiment 5 is the method of any of embodiments 1-4 wherein the netting is laterally stretched by a stretching factor of at least about 100%. Embodiment 6 is the method of any of embodiments 1-5 wherein the netting is in the form of first and second polymer strands that are periodically joined together at bond regions throughout the netting, but do not substantially cross over each other. Embodiment 7 is the method of embodiment 6 wherein the polymer strands of the first set and the polymer strands of the second set are at least substantially coplanar with each other and wherein the netting does not comprise any polymer strands other than those of the first and second sets.

Embodiment 8 is the method of any of embodiments 1-7 wherein the netting, prior to being laterally stretched, exhibits a percent open area of at most about 30%. Embodiment 9 is the method of any of embodiments 1-7 wherein the netting, prior to being laterally stretched, exhibits a percent open area of at most about 20%. Embodiment 10 is the method of any of embodiments 1-9 wherein the netting, after being laterally stretched, exhibits a percent open area of at least about 60%. Embodiment 11 is the method of any of embodiments 1-9 wherein the netting, after being laterally stretched, exhibits a percent open area of at least about 90%.

Embodiment 12 is the method of any of embodiments 1-11 wherein the depositing abrasive particles onto at least some of the first surfaces of the make-coated strands that define the first major surface of the netting, in a pre-determined pattern, is performed by the use of one or more apertured screens, each of which apertures is configured to position an abrasive particle in a specific z-directional orientation, and which apertures are spaced and patterned in a predetermined pattern.

Embodiment 13 is the method of any of embodiments 1-11 wherein the depositing abrasive particles onto at least some of the first surfaces of the make-coated strands that define the first major surface of the netting, in a pre-determined pattern, is performed by the use of a production tool having a dispensing surface with a plurality of cavities, wherein abrasive particles are dispensed from an abrasive particle feeder onto the dispensing surface and into the plurality of cavities, and wherein the abrasive particles are transferred from the plurality of cavities to the first surfaces of the make-coated strands that define the first major surface of the netting. Embodiment 14 is the method of embodiment 13 wherein the abrasive particles are sized so that each abrasive particle fits completely into a cavity of the plurality of cavities. Embodiment 15 is the method of embodiment 13 wherein at least some of the cavities are elongated cavities that exhibit a longitudinal axis, wherein at least some of the abrasive particles are elongated particles that exhibit a longitudinal axis, and wherein the abrasive particles are dispensed onto the dispensing surface and into the plurality of cavities, so that at least some of the elongated particles are disposed in the elongated cavities such that the longitudinal axis of the particle is at least substantially parallel to the longitudinal axis of the elongated cavity.

Embodiment 16 is the method of any of embodiments 1-15 further comprising the step of attaching the laterally-stretched netting bearing a patterned abrasive layer thereon, to a nonwoven fibrous support layer. Embodiment 17 is the method of any of embodiments 1-15 wherein the method comprises attaching multiple laterally-stretched nettings, each bearing a patterned abrasive layer thereon, to each other to form a multilayer article.

Embodiment 18 is a laterally-stretched netting comprising a patterned abrasive layer on a first major surface thereof, comprising: a laterally-stretched netting comprising a lateral width and comprising a first set of polymer strands and a second set of polymer strands, polymer strands of the first set being bonded to polymer strands of the second set at bond regions, and the first and second sets of strands each comprising first surfaces that collectively define a first major surface of the netting; a make coat layer on at least portions of the first major surface of at least some strands of the first set of strands, and on at least portions of the first major surface of at least some strands of the second set of strands; a plurality of abrasive particles at least a majority of which are singly bonded, by way of the make coat layer, to a first surface of a strand of the first or second set of polymer strands.

Embodiment 19 is the laterally-stretched netting of embodiment 18 wherein the plurality of abrasive particles are present in a predetermined pattern. Embodiment 20 is the laterally-stretched netting of embodiment 18 wherein at least a majority of the abrasive particles are present in a predetermined orientation.

Embodiment 21 is the laterally-stretched netting of embodiment 20 wherein the abrasive particles are pyramidal shaped particles and wherein at least a majority of the abrasive particles are present in a predetermined orientation in which a tip of the particle faces outward, away from a major plane established by the first major surface of the laterally-stretched netting. Embodiment 22 is the laterally-stretched netting of any of embodiments 18-21 wherein the laterally-stretched netting exhibits a percent open area of at least about 80%. Embodiment 23 is the laterally-stretched netting of any of embodiments 18-21 wherein the laterally-stretched netting exhibits a percent open area of at least about 90%.

Embodiment 24 is the laterally-stretched netting of any of embodiments 18-23 wherein the netting is in the form of first and second polymer strands that are periodically joined together at bond regions throughout the array, but do not substantially cross over each other. Embodiment 25 is the laterally-stretched netting of embodiment 24 wherein the polymer strands of the first set and the polymer strands of the second set are at least substantially coplanar with each other and wherein the netting does not comprise any polymer strands other than those of the first and second sets.

Embodiment 26 is the laterally-stretched netting of any of embodiments 18-25 wherein the laterally-stretched netting is attached to a fibrous support layer. Embodiment 27 is a multilayer abrasive product comprising multiple layers of the laterally-stretched netting of any of embodiments 18-25, that are attached to each other.

EXAMPLES

A netting was obtained that had been produced in general accordance with the methods described in U.S. Patent Application Publication No. 2014/0234606. The netting was composed of Nylon 66 polymeric fibers with an average diameter of approximately 200 microns. The gaps between the fibers (along the lateral direction of the netting) averaged approximately 300 microns in their relaxed (unstretched) state. The netting generally resembled the exemplary netting shown in FIG. 2.

The first major surface of the unstretched netting was roll-coated with a make coat (precursor) with a hand applicator tool. The resin formulation (make coat precursor) was composed of 50% Phenolic Resin (available from Neste Resins Canada of Missuaga, Ontario, Canada under the trade designation BB077) and 50% Propylene Glycol Methyl Ether Acetate Solvent (available from Dow Chemical, Midland Mich., under the trade designation DOWANOL. PMA). The resin coating appeared sufficient to completely cover the first major surface of the netting while also bridging some of the gaps between the nylon fibers.

Abrasive particles were obtained of the general type described in U.S. Pat. No. 5,201,916 to Berg. Specifically, the abrasive particles were the particles known as Precision Shaped Grain, Grade 36+, which particles are used e.g. in the product available from 3M Company under the trade designation 3M CUBITRON II FIBRE DISC 987C. The products were in the general shape of equilateral triangles, with an average height (base to tip) of approximately 0.049" and with an approximately 3:1 ratio of height to thickness. The abrasive particles were precisely oriented and deposited onto a first major surface of the netting, using a particle patterning process of the general type described in PCT Patent Application Serial Number US2014/071855, entitled A COATED ABRASIVE ARTICLE MAKER APPARATUS. The particles were deposited in a "tip-out" orientation, e.g. as shown in FIG. 6.

The abrasive particles were deposited onto the first major surface of the netting while it was in the previously described relaxed state (and while the make coat was still wet). Once the abrasive particles had been successfully transferred onto the netting material, the netting was substantially manually stretched in the crossweb direction to an estimated stretching factor of 100 percent. This caused the lateral gaps between fibers to expand to an average of approximately 1700 microns.

In the process of crossweb elongation, and while the make coat remained unhardened, the abrasive grains maintained adhesion to the nearest fiber and substantially maintained a specified orientation and pattern in respect to the downweb direction (as can be seen in the exemplary sample shown in FIG. 7).

While the netting remained stretched in the crossweb direction, the netting was adhered to a metal plate and held in an oven at 315° F. for 20 minutes to harden the make coat. Upon being removed from the oven and removed from the holding plate, the netting did recover some of the lateral stretching, so that the final stretching factor of these prototype samples was in the range of approximately 25%.

The laterally-stretched netting with abrasive particles thereon was converted to a 4"×6" rectangle and laminated to a lofty nonwoven web (e.g., a web generally similar to the product available from 3M Company under the trade designation SCOTCHBRITE) with 3M Spray 90 Hi-Strength Spray Adhesive.

The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document incorporated by reference herein, this specification as written will control.

What is claimed is:

1. A method of making a laterally-stretched netting comprising a patterned abrasive layer on a first major surface thereof, the method comprising the steps of, in order:

providing a netting comprising a lateral width and comprising a first set of polymer strands and a second set of polymer strands, polymer strands of the first set being bonded to polymer strands of the second set at bond regions, and the first and second sets of strands comprising first surfaces that collectively define a first major surface of the netting;

coating a make coat layer onto the first major surface of the netting so that at least some first surfaces of strands of the first set of strands, and some first surfaces of strands of the second set of strands, are make-coated strands;

depositing abrasive particles onto at least some of the make-coated first surfaces of strands that define the first major surface of the netting, in a pre-determined pattern;

laterally stretching the netting by a stretching factor of at least about 25%;

and, hardening the make coat layer;

whereby at least a majority of the abrasive particles are each singly bonded to a strand of the laterally-stretched netting.

2. The method of claim 1 wherein the abrasive particles are shaped abrasive particles and wherein the depositing of the shaped abrasive particles is performed so that the particles are deposited onto the make-coated strands in a predetermined orientation.

3. The method of claim 2 wherein at least some of the shaped abrasive particles are at least generally shaped as pyramids with a tip and with a base opposing the tip, and wherein the shaped abrasive particles are deposited onto the make-coated first surfaces of the strands so that the base of the pyramid contacts the make-coated strands.

4. The method of claim 1 wherein the netting is laterally stretched by a stretching factor of at least about 100%.

5. The method of claim 1 wherein the netting is in the form of first and second polymer strands that are periodically joined together at bond regions throughout the netting, but do not substantially cross over each other.

6. The method of claim 5 wherein the polymer strands of the first set and the polymer strands of the second set are at least substantially coplanar with each other and wherein the netting does not comprise any polymer strands other than those of the first and second sets.

7. The method of claim 1 wherein the netting, prior to being laterally stretched, exhibits a percent open area of at most about 30%.

8. The method of claim 1 wherein the netting, prior to being laterally stretched, exhibits a percent open area of at most about 20%.

9. The method of claim 1 wherein the netting, after being laterally stretched, exhibits a percent open area of at least about 60%.

10. The method of claim 1 wherein the netting, after being laterally stretched, exhibits a percent open area of at least about 90%.

11. The method of claim 1 wherein the depositing abrasive particles onto at least some of the first surfaces of the make-coated strands that define the first major surface of the netting, in a pre-determined pattern, is performed by the use of one or more apertured screens, each of which apertures is configured to position an abrasive particle in a specific z-directional orientation, and which apertures are spaced and patterned in a predetermined pattern.

12. The method of claim 1 wherein the depositing abrasive particles onto at least some of the first surfaces of the make-coated strands that define the first major surface of the netting, in a pre-determined pattern, is performed by the use of a production tool having a dispensing surface with a plurality of cavities, wherein abrasive particles are dispensed from an abrasive particle feeder onto the dispensing surface and into the plurality of cavities, and wherein the abrasive particles are transferred from the plurality of cavities to the first surfaces of the make-coated strands that define the first major surface of the netting.

13. The method of claim 12 wherein the abrasive particles are sized so that each abrasive particle fits completely into a cavity of the plurality of cavities.

14. The method of claim 12 wherein at least some of the cavities are elongated cavities that exhibit a longitudinal axis, wherein at least some of the abrasive particles are elongated particles that exhibit a longitudinal axis, and wherein the abrasive particles are dispensed onto the dispensing surface and into the plurality of cavities, so that at least some of the elongated particles are disposed in the elongated cavities such that the longitudinal axis of the particle is at least substantially parallel to the longitudinal axis of the elongated cavity.

15. The method of claim 1 further comprising the step of attaching the laterally-stretched netting bearing a patterned abrasive layer thereon, to a nonwoven fibrous support layer.

16. The method of claim 1 wherein the method comprises attaching multiple laterally-stretched nettings, each bearing a patterned abrasive layer thereon, to each other to form a multilayer article.

* * * * *